United States Patent [19]

Barker

[11] 4,251,105

[45] Feb. 17, 1981

[54] MOBILITY AID

[76] Inventor: Alfred W. Barker, "Panorama", Petit Port, St. Brelade, Jersey, Channel Islands

[21] Appl. No.: 54,424

[22] Filed: Jul. 3, 1979

[30] Foreign Application Priority Data

Jul. 5, 1979 [GB] United Kingdom ..... 28967/79

[51] Int. Cl.[3] ..... A61H 3/04

[52] U.S. Cl. ..... 297/6; 135/67; 272/70.4

[58] Field of Search ..... 135/67, 85, 65; 272/70.3, 70.4; 297/5, 6

[56] References Cited

U.S. PATENT DOCUMENTS

| | | | |
|---|---|---|---|
| 2,621,707 | 12/1952 | Ames | 272/70.4 |
| 2,690,788 | 10/1954 | Ames | 297/6 |
| 2,745,465 | 5/1956 | Hogan | 135/67 X |
| 2,792,874 | 5/1957 | Sundberg | 135/67 X |
| 3,195,550 | 7/1965 | Ingalls et al. | 135/67 |

FOREIGN PATENT DOCUMENTS

| | | | |
|---|---|---|---|
| 401711 | 9/1924 | Fed. Rep. of Germany | 272/70.3 |
| 1096547 | 12/1967 | United Kingdom | 135/67 |
| 1342397 | 1/1974 | United Kingdom | 135/67 |

*Primary Examiner*—J. Karl Bell
*Attorney, Agent, or Firm*—Kurt Kelman

[57] ABSTRACT

A mobility aid comprises a four-legged walking frame characterized by the front legs of the frame having ground-engaging wheels with axes movable in unison in the direction of the lengths of the legs, by one-way wheel-driving means responsive to upwards movement of said wheel axes to cause forward rotational motion of the wheels, and by resilient means acting to urge said wheel axes downwardly of the front legs.

In the freestanding condition of the frame, the resilient means lift the front of the frame so that when the frame is pressed down by the user bearing down on the frame, the wheels are caused to rotate in the sense to cause forward movement of the aid, the rear legs dragging as a result. A repeated bearing down action, easily accomplished even by the severely handicapped, thus results in easily controllable forward motion of the aid.

15 Claims, 9 Drawing Figures

MOBILITY AID

BACKGROUND OF THE INVENTION

This invention concerns mobility aids, that is, devices for assisting the handicapped and/or infirm to move with a walking action: typical such devices are the stick, the crutch and the so-called "walking frame" and it is with the latter type of mobility aid that the invention is especially concerned.

In its simplest form, a typical walking frame comprises a four-legged tubular metal frame that is generally U-shaped in plan, being open at the rear to permit a user to enter and stand within the frame. It is necessary for the user repeatedly to lift the frame and move it an appropriate distance in the desired direction—an awkward and tiring action that is difficult or impossible for the relatively seriously handicapped or infirm to perform.

It has been proposed to provide the legs of such frames with ground-engaging wheels, casters or gliders and, as a safety feature, such frames may have braking arrangements for preventing movement of the frame upon application of an appropriate download to the frame.

For example, British Patent specification No. 1342397 discloses a walking frame equipped with wheels or casters that are mounted for limited upward movement in the legs of the frame, against the thrust of springs, so that when weight is applied to the frame the wheels move upwardly relative to lugs on the frame legs, the wheels or casters engaging these lugs so as to be braked against rotation.

Further, British Patent specification No. 1373593 describes a similar system using gliders instead of wheels. The gliders have a downwardly spring-loaded sleeve the lower end of which provides a gliding surface and that surrounds a plug of rubber or plastics material providing a gripping surface that is pressed into engagement with the ground when weight is put on the frame so as to cause the sleeve to be pressed upwardly relatively to the plug.

Such wheeled etc. frames are, however, similarly difficult or impossible to use by the relatively seriously handicapped or infirm who need a large degree of support from the frames and must consequently lean very heavily thereon. Furthermore, such frames are not confidence-inspiring to use because of the possibility of the frame "running away" with the user.

It is thus an objective of the invention to provide a walking frame that permits a greater degree of control by the user and that is suitable for use even by the relatively severely handicapped or infirm and capable of greatly enhancing the mobility of such a user.

SUMMARY OF THE INVENTION

In its broadest aspect the present invention provides a mobility aid comprising a four-legged frame characterised by the front legs of the frame having ground-engaging wheels with axes movable in unison in the direction of the length of said legs, by one-way wheel-driving means responsive to upwards movement of said wheel axes to cause forward rotational motion of the wheels, and by resilient means acting to urge said wheel axes downwardly of the front legs.

The arrangement of the wheels, the wheel-driving means and said resilient means is such that in the free-standing condition the latter lift the front of the frame so that when the frame is pressed down by the user bearing down on an appropriate part of the frame, the wheels are caused to rotate in the sense to cause forwards movement of the aid, the rear legs dragging as a result. A repeated bearing down action, easily accomplished even by the severely handicapped, thus results in forward motion of the aid without requiring lifting of the aid by by the user. This motion is easily controlled because part of the download applied by the user to the frame is transmitted to the rear legs of the aid and therefore results in braking resistance to forward motion; the proportion of the total download that generates braking resistance in this way is easily, and substantially instinctively, varied by the user in a way that inspires the confidence of the user.

The wheels are constrained to move in unison relatively to the front legs so that even if the rear legs are raised clear of the ground there is no tendency to lateral tilting of the frame in response to uneven loading of the frame, as for instance might arise from stumbling by the user or from asymmetric weakness of the latter—another feature conducive to rapid acquisition of confidence in use of the aid.

Preferably the one-way wheel-driving means permit independent forward rotation of the wheels so that differential rotation may occur to facilitate changing the direction of motion of the aid while it is moving forwardly under the influence of an applied download on the frame.

Conveniently the wheels are carried by a common axle that extends through longitudinal slots in each of the front legs of the frame. Preferably such an axle is supported within each leg in a bearing sleeve slidable within the leg and urged downwardly of the latter by a spring or other suitable resilient strut housed within the leg above the bearing sleeve.

In preferred embodiments, the front legs of the frame have stabilizer struts projecting forwardly and downwardly to engage the ground ahead of the wheel contact patches under circumstances in which forwards toppling of the aid might occur, and desirably the lower ends of the front legs, or of said stabilizer struts, and the wheels are so related in position and in regard to the permitted upwards movement of the wheels that the extremities of the legs and/or of said struts engage the ground when the wheels are in their highest position, thereby enabling the user, by applying appropriate pressure to the front of the frame, to cause both the rear legs and the front legs and/or the struts to engage the ground to prevent motion thereover. Conveniently such stabilizer struts are of adjustable length to permit regulation of the permitted upwards movement of the wheels. The extremities of the legs and of the stabilizer struts may be tipped or capped with appropriate material to resist wear and yet provide adequate non-skid grip upon, e.g., a polished floor surface.

The one-way wheel-driving means may take any suitable form but ratchet and freewheel mechanisms are convenient and robust devices for use as such means. Thus, for instance, each ground-engaging wheel may have incorporated in the hub thereof a ball ratchet freewheel mechanism arranged to cause the wheel to rotate in response to upwards movement of the wheel axis relatively to the leg. In preferred embodiments the one-way driving means are integrated with means for causing the wheel axes to move in unison in relation to the respective front legs, the legs being fitted with toothed racks engaged by pinions on the common axle so that the latter is both held in a constant attitude with respect to the frame of the aid while moving up and down relatively to the front legs, and caused to rotate while so moving. Ratchet insets fixed to the axle rotate therewith and transmit forward rotation of the axle to the ground-engaging wheels via balls urged into engagement with an appropriately ramped surface on the latter, the ground-engaging wheels being otherwise freely rotatable on the axle to provide for differential forwards rotation of these wheels.

As an alternative to such freewheel mechanisms, ratchet and pawl mechanisms could be used to transmit forward rotation of the axle to the wheels. For example, each ground-engaging wheel may be fitted with a pawl adapted to engage a ratchet wheel fixed to the common axle to rotate therewith and transmit forwards rotation of the axle to the wheel via the pawl on the latter.

The download applied to the ground-engaging wheel axes by the resilient means may be adjustable to suit the physique and weight of the intended user, so that reliable raising of the front of the aid is induced by the resilient means.

The frame conveniently has lateral supports positioned for engagement by the forearms of a user, and such supports may be shaped and padded as desired for comfortable engagement by the forearms of the user. Alternatively, the frame may be fitted with arm crutches, arm support grips, hand grips or the like for appropriate engagement by the user.

The frame of the aid may be fitted with a hinged seat member that may be moved from a stowed (e.g. vertical) position to a horizontal position at a suitable level within the frame to convert the aid into a chair to enable the user to rest when desired. The frame may also have a basket or other container removably fitted thereto to facilitate transportation of articles by a user.

BRIEF DESCRIPTION OF THE DRAWINGS

Preferred embodiments of the invention will now be described, by way of example, with reference to the accompanying drawings, in which.

DETAILED DESCRIPTION OF THE INVENTION

Figure 1:
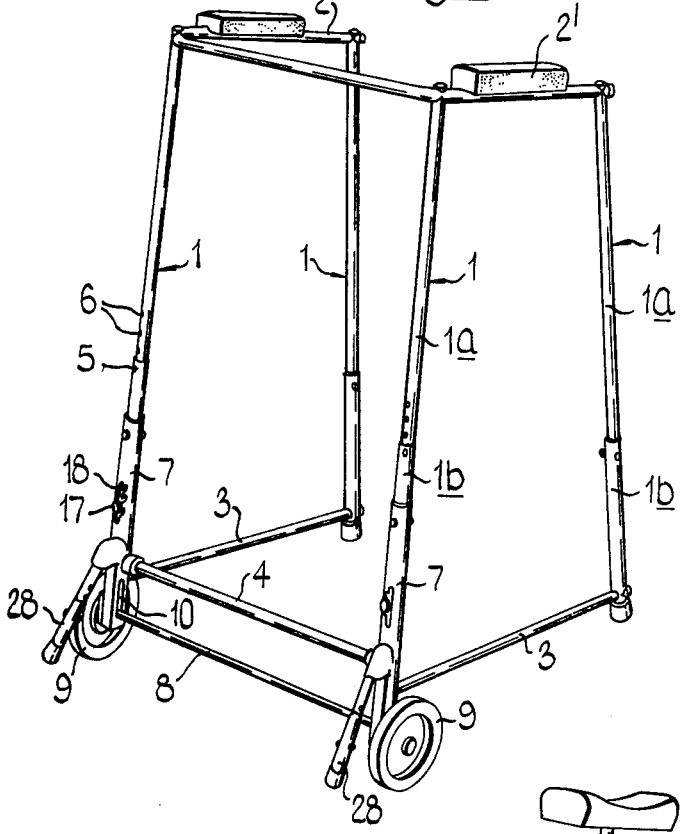
FIG. 1 is a perspective view of one embodiment of a mobility aid in accordance with the present invention, shown in freestanding condition with the ground-engaging wheels at their lowest position relative to the front legs.

Referring to the drawings, the mobility aid illustrated in FIGS. 1 to 5 comprises four-legged tubular metal (for example aluminium) walking frame that is generally U-shaped in plan, being open at the rear to permit a user to enter and stand within the frame. The frame thus comprises four legs 1, the upper ends of which are connected by means of a U-shaped tubular member 2 secured thereto, by means of suitable saddle washers and set bolts, the lateral parts of member 2 each having a padded armrest 2' for engagement by the forearms of the user when standing within the frame. The lower ends of the legs 1 are similarly connected by means of respective tubular side members 3, one at each side of the frame, and a tubular front cross member 4.

Each leg 1 is adjustable in length, comprising relatively slidable upper, inner and lower, outer circular section tubular members, 1*a* and 1*b*, respectively, that can be secured together in a plurality of different relative positions by means of a fixing pin 5 passed through appropriately aligned holes 6 in the members. By appropriately adjusting the lengths of the legs 1 in this way, the height of the frame can be adjusted to the requirements of a particular user. when all of the legs 1 are in the fully extended condition, the height of the front of the frame, in the freestanding condition thereof, is 33 inches (840 mm) and the height of the rear of the frame is 30 inches (750 mm), the front legs 4 being rearwardly inclined at an angle of about 10° to vertical, while the rear legs are similarly rearwardly inclined at an angle of about 4° to vertical.

Figure 2:
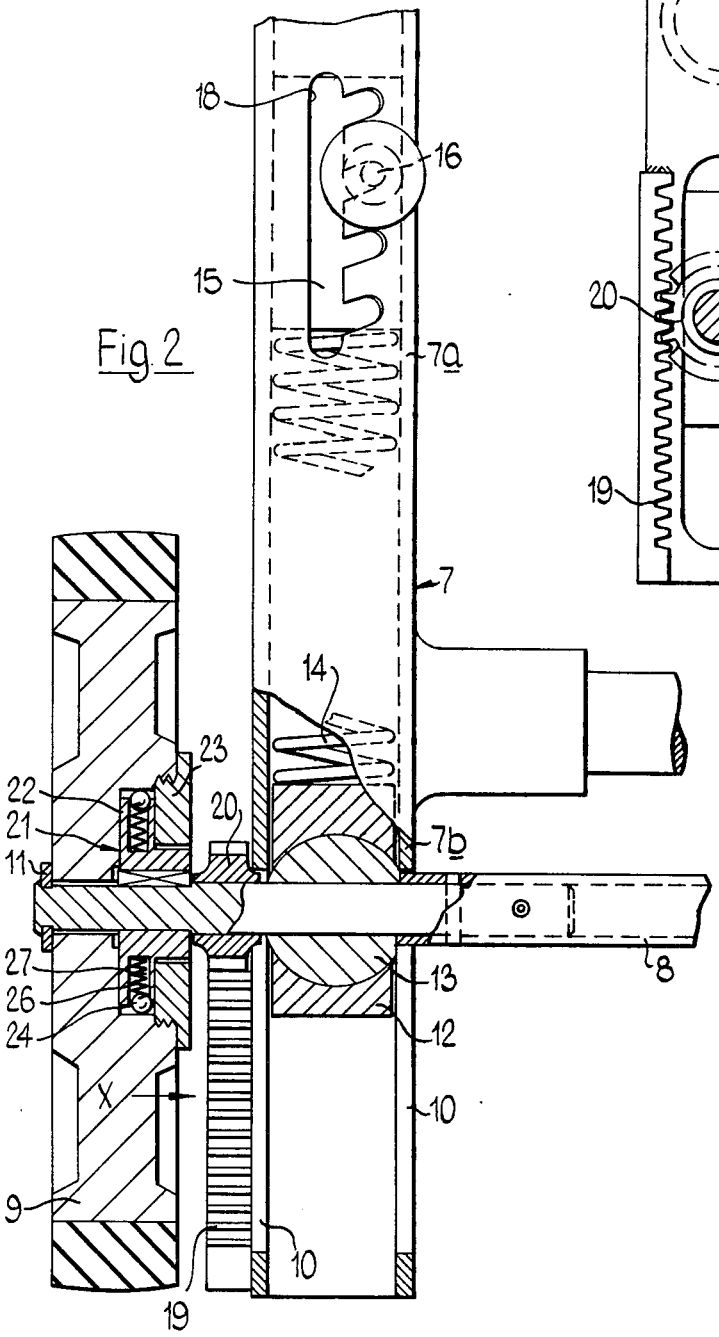
FIG. 2 shows, on an enlarged scale and partly in section, the lower part of the left hand front leg and associated ground-engaging wheel of the aid of FIG. 1, seen from the rear, with the aid in a fully compressed condition and the wheel at its highest position relative to the leg.
Figure 4:
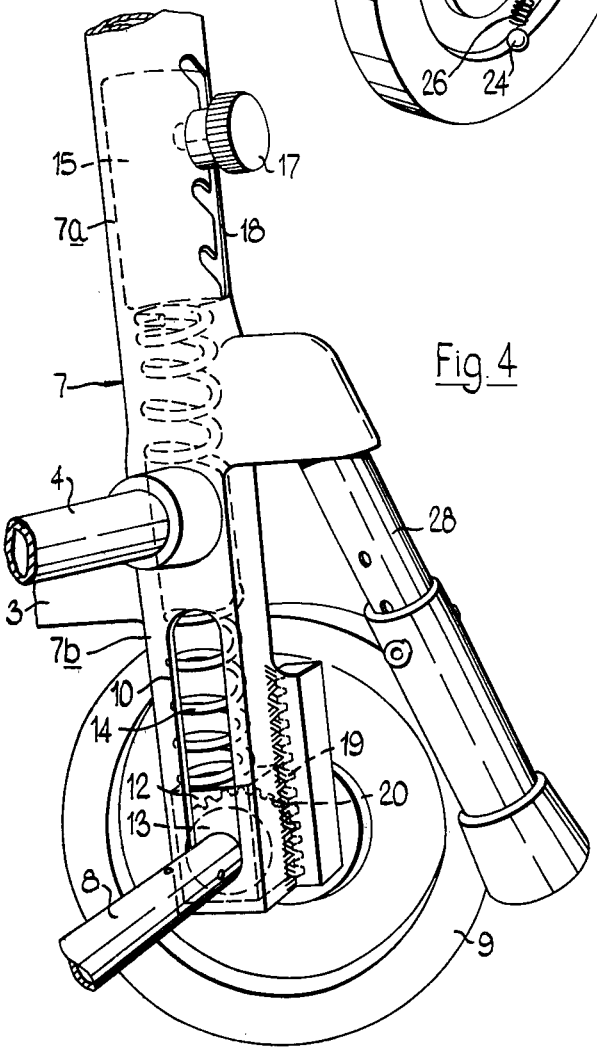
FIG. 4 is a perspective view of the lower part of the leg and wheel shown in FIG. 2, with the aid shown in the freestanding condition of FIG. 1.

As best shown in FIGS. 2 and 4, each front leg further comprises a tubular die-cast member 7 having an upper circular section portion 7*a* that receives the associated tubular member 1*b* and a lower square section portion 7*b*. An axle 8 carring a rubber tyred ground-engaging wheel 9 at each end thereof spans the front of the frame, passing through a series of four longitudinal slots 10, one in each lateral face of the lower portion 7*b* of members 7, the wheels 9 being situated outboard of the associated front leg and being retained on the axle by means of respective circlips 11. The axle 8 is supported within each front leg member 7 in a bearing sleeve 12, via appropriate spherical self-aligning inserts 13, slidable within the member 7 and urged downwardly of the latter by a spring 14 housed within the member 7 above the bearing sleeve 12. The upper end of the spring 14 is engaged by a slidable plunger 15 that can be selectively retained in one of four positions along the length of the leg by engagement of an adjusting rod 16, fixed to the plunger and having a terminal knob 17, in an appropriate position in notched slot 18 at the front of member 7, to permit adjustment of the spring load and hence adjustment of the download applied to the axle 8 to suit the physique and weight of the intended user.

Each member 7 is fitted with a toothed rack 19 adjacent to the outer slot 10, the rack 19 cooperating with respective pinions 20 on the axle 8 so that the latter is both held in a constant attitude with respect to the frame while moving up and down relatively to the front legs, between the lowest position as shown in FIG. 4 and the highest position as shown in FIG. 10, and caused to rotate while so moving, rotating in a forward direction on upward movement, and vice versa.

Figure 5:
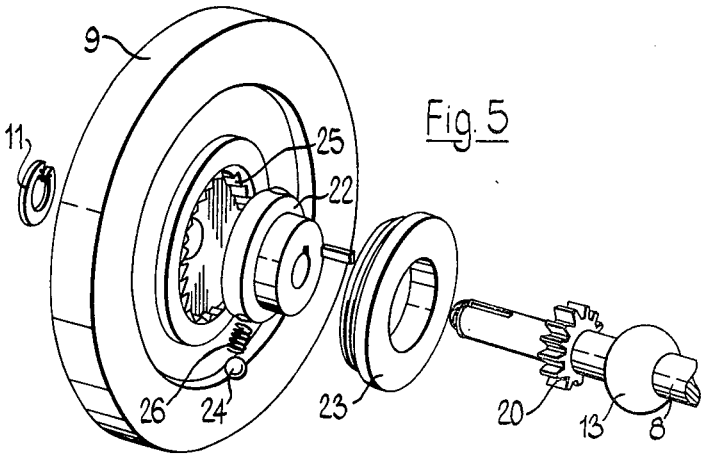
FIG. 5 is an exploded perspective view of one of the ground-engaging wheels and associated freewheel assembly of the aid of FIG. 1.

Forward rotation of the axle 8 is transmitted to the wheels 9 by means of respective ball ratchet freewheel mechanisms 21 incorporated in the hub of each wheel. As best shown in FIG. 5, the freewheel mechanism 21 comprises a steel ratchet insert 22 keyed to axle 8 and located within the wheel hub by means of a threaded retainer ring 23 such that steel balls 24 are urged into engagement with an appropriately ramped cylindrical surface 25 of the hub by means of associated springs 26 located in radial bores 27 in the ratchet insert 22. The arrangement is thus such that the wheels 9 are freely rotatable in a forward direction on the axle 8 and are caused to rotate in this sense by forward rotation of the axle caused by upward movement thereof relative to the front legs 1.

As shown in FIGS. 1 and 4, the front legs of the frame have rubber capped stabilizer struts 18 projecting forwardly and downwardly to engage the ground ahead of the wheel contact patches under circumstances in which forwards toppling of the aid might occur. The struts are of adjustable length, being of telescopic tubular construction, and may thus be used to regulate the permitted upward movement of the wheels relative to the front legs and hence to regulate the forward movement of the frame caused by such movement of the wheels.

It can thus be seen that when the frame is pressed down from the freestanding condition by a user bearing down on the padded armrests 2 with an appropriate forward component to overcome the braking action of the rear legs, the wheels 9 are caused to rotate in the sense to cause forward movement of the aid. When the download is removed, the springs 14 act to urge the axle downwardly of the front legs, restoring the frame to the freestanding condition and completing the cycle of movement.

In this embodiment, the ground-engaging wheels 9 are 5 inches (127 mm) in diameter, and the axes thereof are permitted to move a total of about $1\frac{5}{8}$ inches (41 mm) relatively to the front legs, the rack and pinion gear ratio giving about one half revolution of the axle for a full distance movement of the wheel axes: for a full downwards movement of the front of the frame, the arrangement thus produces a forward movement of about 8 inches (203 mm).

Other relationships between the frame front down motion and forward advance may of course be obtained by varying the rack and pinion ratio and/or the wheel diameter and/or the total permitted movement of the wheel axes relatively to the front legs, the latter factor conveniently being varied by adjustment of the length of the stabilizer struts 28.

It will be apparent that because the freewheel mechanism 21 permits independent forward rotation of the wheels so that differential rotation may occur, the direction of motion of the aid while it is moving forwardly under the influence of an applied download can be changed relatively easily by applying an appropriate directional component to the frame.

Further, the freewheel mechanisms permit the frame to be moved forward continuously while nevertheless providing some support for the user, and may thus be used to encourage and teach the user to walk naturally and smoothly.

Figure 6:
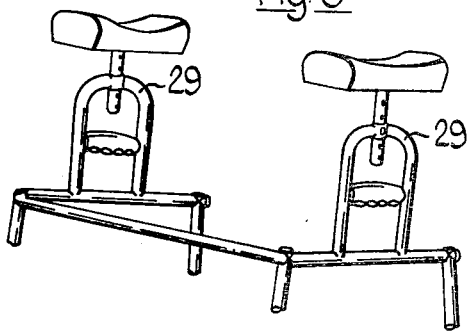
FIG. 6 is a perspective view of an upper portion of a modified version of the Fig. 1 embodiment, fitted with arm crutches.

As shown in FIG. 6, the frame of FIG. 1 may be modified by replacing the padded armrests 2 with arm crutches 29, this modified embodiment being particularly suitable for use by, for example, one-legged users.

Figure 7:
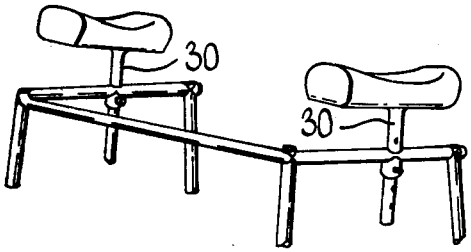
FIG. 7 is a view similar to FIG. 6 of a further modification.
Figure 3:
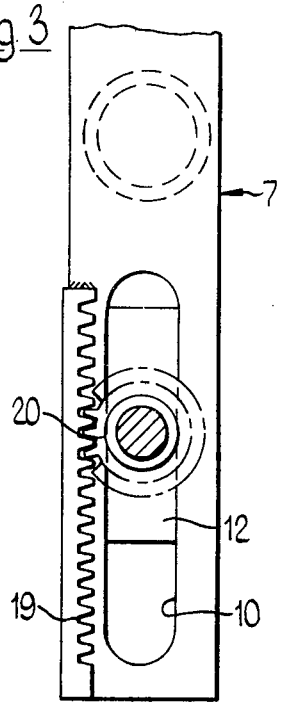
FIG. 3 is a view in the direction of arrow X of FIG. 2 with the wheel and associated components removed and the aid in a partly compressed condition.
Figure 8:
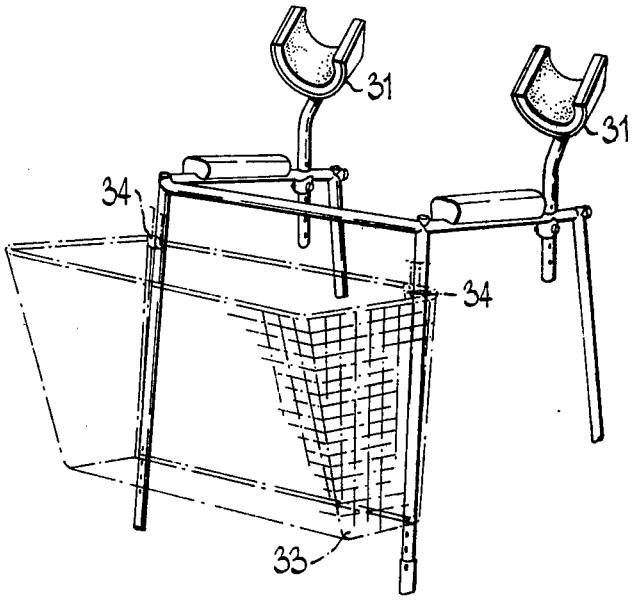
FIG. 8 is a view similar to FIG. 6 of another modification.
Figure 9:
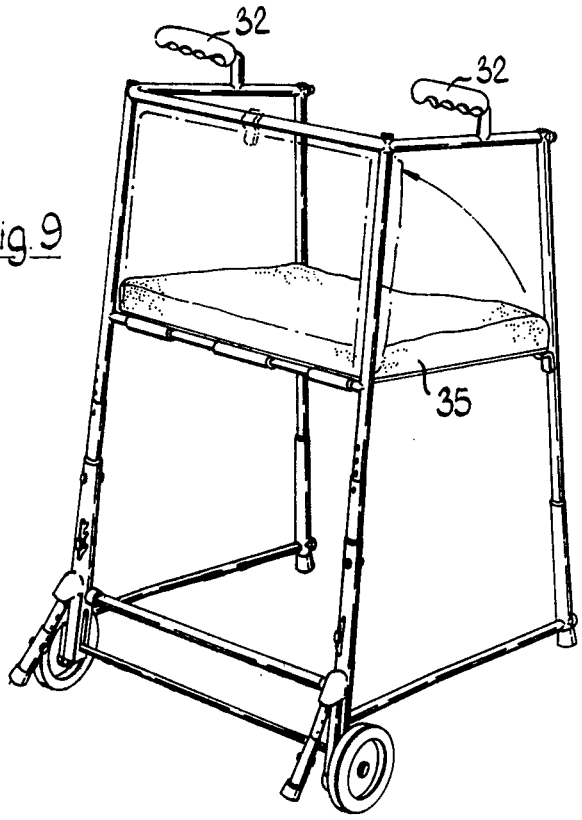
FIG. 9 is a view similar to FIG. 1 of a further modified version.

The frame may alternatively be modified by the addition of arm crutches 30 of the configuration shown in FIG. 7, or by the addition of arm support grips 31 as shown in FIG. 8, or by the addition of hand grips 32 as shown in FIG. 9.

Further, the embodiment of FIG. 8 is also modified by the addition of a basket 33 removably secured to appropriate fixing hooks 34 on the front legs 1.

In addition, the embodiment of FIG. 9 is fitted with a hinged seat member 35 that may be moved from a stowed, vertical position, shown in dot dash lines in the Figure, to a horizontal position of use as shown in full lines to convert the aid into a chair.

I claim:

1. A mobility aid comprising:

(a) a frame having two front legs and two rear legs;

(b) a ground-engaging wheel on each front leg, the axes of the wheels being movable in unison in the direction of the lengths of said front legs;

(c) one-way wheel-driving means responsive to upwards movement of said wheel axes to cause forward rotational motion of the wheels; and (d) resilient means acting to urge said wheel axes downwardly of the front legs.

2. The aid of claim 1 in which said one-way wheel-driving means permit independent forward rotation of the wheels.

3. The aid of claim 1 including a common axle extending through longitudinal slots in each of said front legs, said axle carrying said wheels.

4. The aid of claim 3 including a bearing sleeve slidably housed within each front leg and supporting said common axle, said resilient means being housed within each leg above the bearing sleeve and urging the latter downwardly of the leg.

5. The aid of claim 3 or 4 further comprising toothed racks fitted to the front legs and engaged by pinions on the common axle so that the latter is both held in a constant attitude while moving up and down relatively to the front legs, and caused to rotate while so moving.

6. The aid of claim 3, 4 or 5 in which the one-way wheel-driving means comprise a ball ratchet freewheel mechanism incorporated in the hub of each wheel and arranged to transmit forward rotation of the axle to the wheels, the wheels being otherwise freely rotatable on the axle.

7. The aid of claim 1 including stabilizer struts projecting forwardly and downwardly from the front legs.

8. The aid of claim 7 in which the lower ends of the front legs, or of said stabilizer struts, and the wheels are so related in position and in regard to the permitted upwards movement of the wheels that the extremities of the front legs and/or of said struts engage the ground when the wheels are in their highest position.

9. The aid of claim 7 in which the stabilizer struts are of adjustable length.

10. The aid of claim 1 in which the one-way wheel-driving means comprise a ball ratchet freewheel mechanism incorporated in the hub of each wheel.

11. The aid of claim 1 including means for adjusting the download applied to the wheels by said resilient means.

12. The aid of claim 1 in which the frame includes lateral supports positioned for engagement by the forearms of a user.

13. The aid of claim 1 in which the frame is fitted with arm crutches, arm support grips, hand grips or the like for appropriate engagement by the user.

14. The aid of claim 1 in which the frame is fitted with a hinged seat member.

15. The aid of claim 1 further comprising a basket or other container removably fitted to the frame.

* * * * *